US005462297A

United States Patent [19]

Lee

[11] Patent Number: 5,462,297

[45] Date of Patent: Oct. 31, 1995

[54] ROLLER-SKATE WITH IMPROVED BRAKE DEVICE

[75] Inventor: Min-Kuo Lee, Chia Yi Hsien, Taiwan

[73] Assignee: Hi-Star Co., Ltd., Chia Yi Hsien, Taiwan

[21] Appl. No.: 326,234

[22] Filed: Oct. 20, 1994

[51] Int. Cl.[6] ..... A63C 17/14

[52] U.S. Cl. ..... 280/11.2; 280/11.22; 280/11.28

[58] Field of Search ..... 280/11.19, 11.2, 280/11.22, 11.23, 11.27, 11.28; 188/5, 6, 7

[56] References Cited

U.S. PATENT DOCUMENTS

| | | | |
|---|---|---|---|
| 968,427 | 8/1910 | Simon | 280/11.2 |
| 4,909,523 | 3/1990 | Olson | 280/11.2 |

FOREIGN PATENT DOCUMENTS

| | | | |
|---|---|---|---|
| 386288 | 12/1923 | Germany | 280/11.2 |

*Primary Examiner*—Richard M. Camby
*Attorney, Agent, or Firm*—Browdy and Neimark

[57] ABSTRACT

The discloure relates to a roller-skate with improved brake device. A guidance slanting upwards is disposed at a first through hole of the skate body for the mounting of a first rolling axle having a first wheel member rotatably engaged therewith. A spring mount fixed with a brake plate having brake lining underside both its ends is mounted between the first and the second wheel members. When the wheel support lurches forwards, the first wheel member will move upwards through the guidance, urging against the brake lining fixed under brake plate fixed to the spring mount to achieve the effect of braking the skate. Moreover, when pressed at one end, the brake plate, by leverage, will bend at the other end to limit the motion of the second wheel member and thus further contributes to the effectivity of the brake device.

1 Claim, 4 Drawing Sheets

ROLLER-SKATE WITH IMPROVED BRAKE DEVICE

BACKGROUND OF THE INVENTION

The present invention relates to a roller-skate with an improved brake device.

Referring to FIG. 1, a conventional one-row skate comprises a skate body 11, a skate sleeve 12, a wheel support 13, and wheel members 14. The skate body 11, moulded according to the shape of a human foot, are provided with lace holes for the passage of shoelace 15 therethrough; and ventilated holes 16 of various shapes to keep the the interior of the skate body ventilating, making a wearer feel comfortable.

The skate sleeve 12 is made of sponge and fitted in the skate body 11 to separate a user's foot from the skate body 11 and to protect the user's foot. The wheel support 13 is secured to the underside of the skate body and the wheel members 14 are rotatably mounted to the wheel support 13 at equal intervals. A brake block 17 is disposed at the rear end of the wheel support 13.

Several drawbacks are found in the above conventional one-row skate as follows:

1. Because no brake device is disposed at the front end of a conventional one-row skate, the user must lurch backwards to stop the motion of a skate. This may cause the skater to fall from loss of balance.

2. Through friction in direct contact with the ground, the brake block disposed at the rear end of the skate is reduced in volume due to constant abrasion. This results in the need for replacement and also increasing the danger of falling when the user must lurch backwards in a larger angle to stop the skate.

SUMMARY OF THE INVENTION

It is, therefore, the primary object of the present invention to provide a roller-skate with an improved brake device. A guidance slot which slants upwards is disposed at the front end of the wheel support first rolling axle passes through the guidance slot with a first wheel member engaged to this axle. A spring mount, fixed with a brake plate having brake lining disposed under both its ends, is mounted between the first and the second wheel members. When the wheel support lurches forward, the first wheel member will move upwards through the slanting guidance slot to press against the brake lining of the brake plate. The brake plate then bend downwards at the other end to stop the motion of the second wheel member so as to effect braking on a skate.

It is a further object of the present invention to provide a roller skate with an improved brake device wherein the life of an improved brake device of a skate is prolonged due to avoidance of direct abrasion against the ground when in operation.

DETAILED DESCRIPTION OF THE PREFERRED EMBODIMENT

Figure 1:
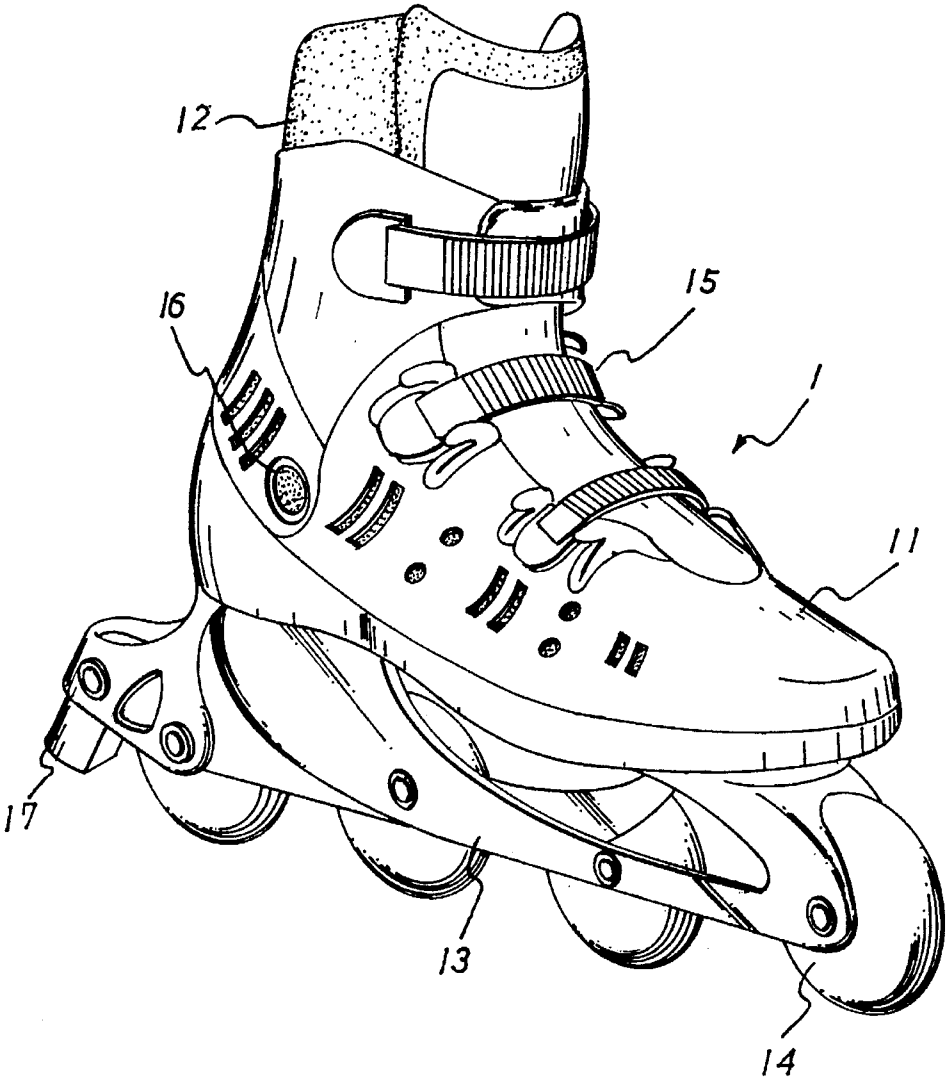
FIG. 1 is a perspective view of a conventional one-row skate.
Figure 2:
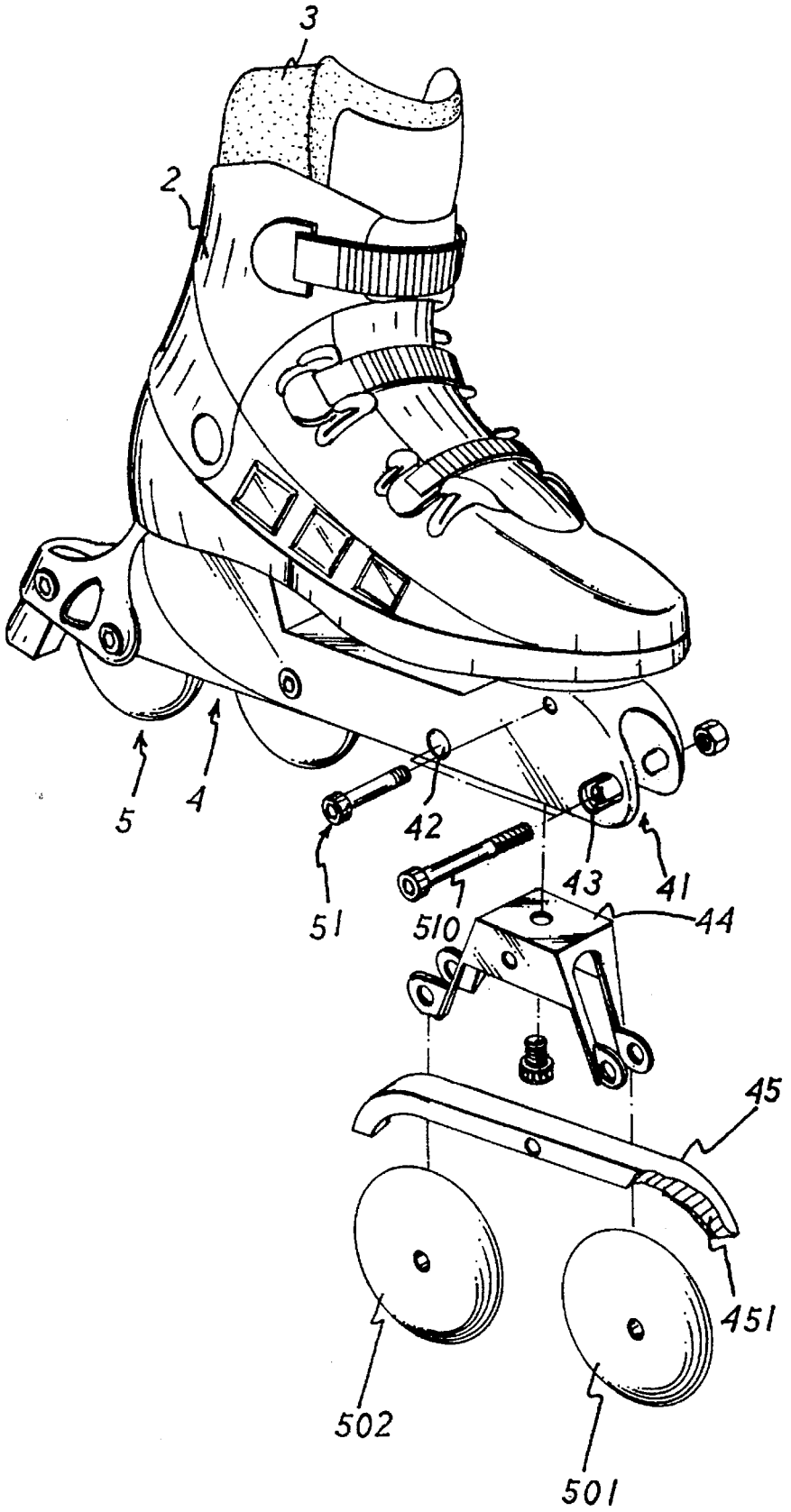
FIG. 2 is a perspective diagram showing the exploded components of the present invention.
Figure 3:
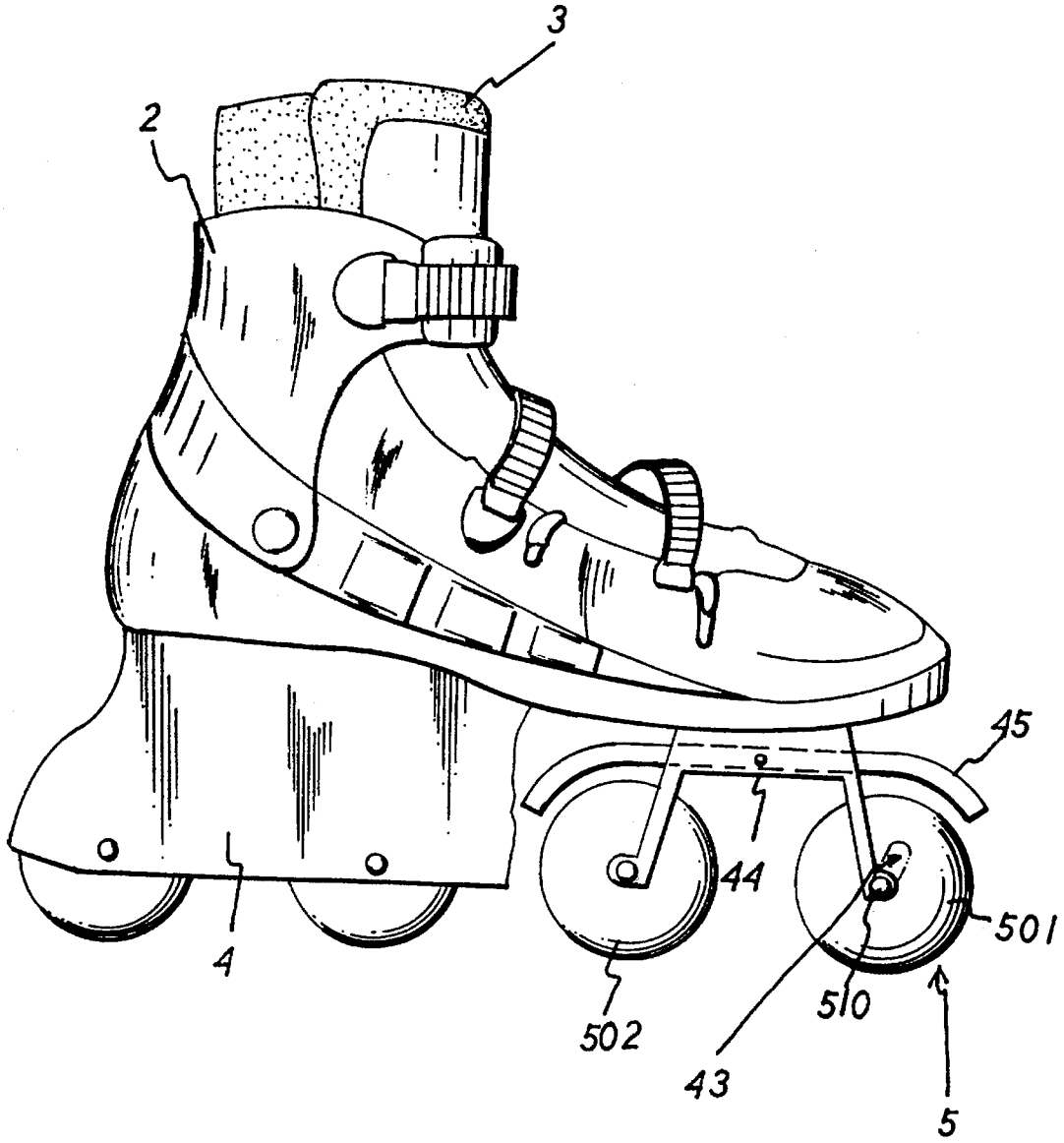
FIG. 3 is a diagram showing a partially cross sectional view of the present invention.
Figure 4:
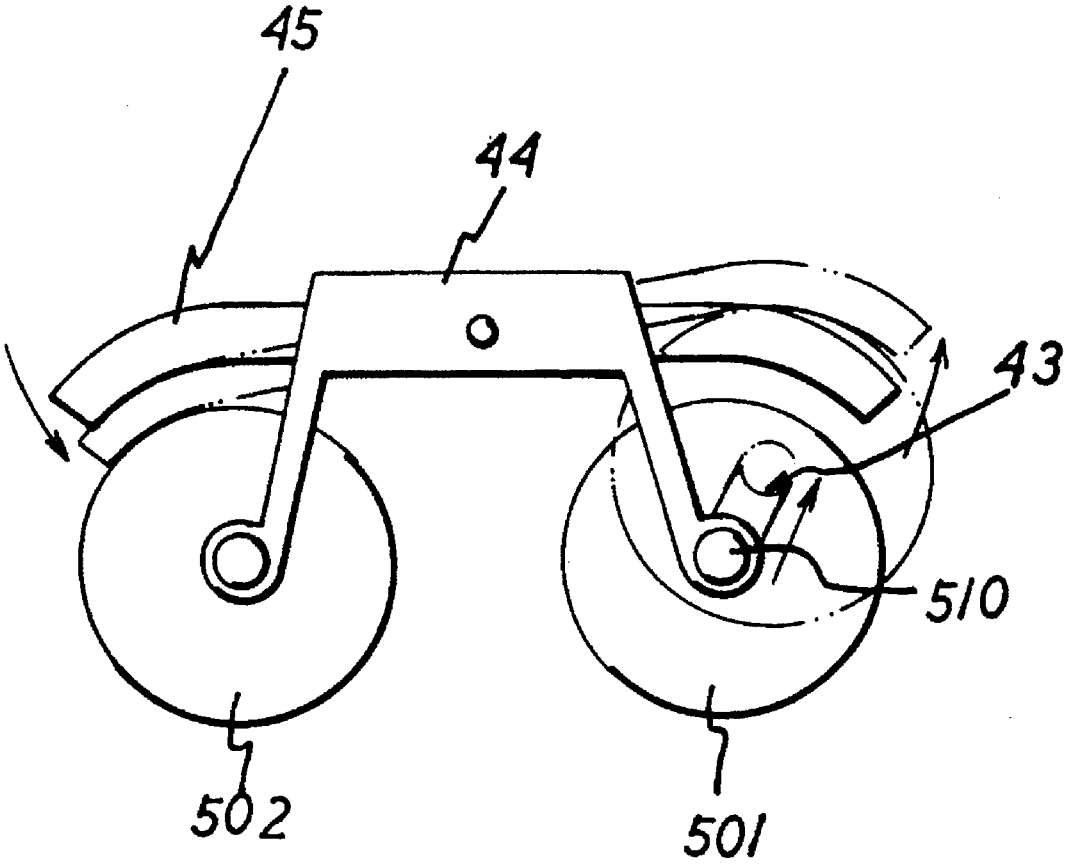
FIG. 4 is a diagram showing an operational mode of the present invention.

Referring to FIGS. 2, 3, and 4. The present invention relates to a one-row skate with an improved brake device, comprising a skate body 2, a skate sleeve 3, a wheel support 4, and wheel members 5, wherein the skate body 2, the skate sleeve 3, and wheel members 5 are the same as a conventional one-row skate.

The wheel support 4 is fixed to the underside of the skate body 2, having a longitudinal groove 41 at the center of its body. Several through holes 42 for the mounting of rolling axles 51 are disposed at an equal interval along both sides of the groove 41. A rolling axle 51 and spindle bearings, are fixed in place on each wheel member 5, arranging the wheel members in a row inside the groove 41 at equal intervals. A first rolling axle 510, is engaged in guidance slot 43 which slants slightly upwards allows movement of the first rolling axle 510. At the upper position between the first and second wheel members 501, 502 is fixed a spring mount 44 having a brake plate 45 with brake lining 451 disposed at the underside of both ends of the brake plate.

In operation, the first rolling axle 510 is mounted with the first wheel member 501 at the bottom of the guidance slot 43 to contain the brake device from interfering with the normal function of the skate. To use the brake device, all one has to do is to bend forwards weighing down the first wheel member 501 and forcing the first rolling axle 510 to move upwards through the guidance slot 43, thereby. The friction in contact with the brake lining 451 underside the brake plate 45 mounted onto the spring mount 44 between the first and second wheel members 501, 502, stops the motion of the skate. Moreover, through leverage, the rear end of the brake plate 45 will weigh down onto the second wheel member 502 to hinder the motion of the second wheel member 502 when the upper end of the brake plate 45 bends upwards under the pressure of the first wheel member 501.

What is claimed is:

1. A roller-skate with improved brake device, comprising a skate body, a skate sleeve, a wheel support, and wheel members;

said skate sleeve made of sponge and fitted in the skate body to separate a user's foot from the skate body for protection of a user's foot;

said skate body molded in the shape of a man's foot and provided with lace holes for passage of a shoelace therethrough and ventilating through holes of various shapes to keep the interior of the shoe body ventilated;

said wheel support mounted under said skate body, forming a longitudinal groove at a center of wheel support, both sides of wheel support having several through holes at equal intervals for the mounting of rolling axles, and by way of spindle bearings, fixing the wheel members inside of the longitudinal groove in a row at equal intervals;

a spring mount engaged to said wheel support, a guidance slot slanting upwards on said wheel support to allow the upward movement of a first rolling axle within the guidance slot; and a brake plate engaged within the spring mount, the brake plate having a brake lining fixed in place between a first wheel member and a second wheel member;

wherein when a skater lurches forward, the first rolling axle moves upwards through the guidance slot against a first end of the brake plate and the brake lining and through leverage, bends the brake plate downward so that a second end of the brake plate and brake lining engages against the second wheel member to further limit motion of the second wheel member, thereby effecting braking of both the first wheel and the second wheel member.

* * * * *